US010991486B2

(12) United States Patent
Uchida

(10) Patent No.: US 10,991,486 B2
(45) Date of Patent: Apr. 27, 2021

(54) ALUMINUM WIRE MANUFACTURING METHOD

(71) Applicant: Yazaki Corporation, Tokyo (JP)

(72) Inventor: Naonari Uchida, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 480 days.

(21) Appl. No.: 14/942,229

(22) Filed: Nov. 16, 2015

(65) Prior Publication Data

US 2016/0071633 A1 Mar. 10, 2016

Related U.S. Application Data

(63) Continuation of application No. PCT/JP2014/063081, filed on May 16, 2014.

(30) Foreign Application Priority Data

May 17, 2013 (JP) ..... JP2013-105451

(51) Int. Cl.
*H01B 13/02* (2006.01)
*C22F 1/04* (2006.01)
(Continued)

(52) U.S. Cl.
CPC ..... *H01B 13/02* (2013.01); *B21C 1/02* (2013.01); *B21C 1/04* (2013.01); *B21C 3/12* (2013.01);
(Continued)

(58) Field of Classification Search
CPC ..... H01B 13/02; H01B 13/0891; H01B 13/0883; C22F 1/04; C22C 21/00; B21C 1/02; B21C 1/04
See application file for complete search history.

(56) References Cited

U.S. PATENT DOCUMENTS

2007/0251204 A1* 11/2007 Susai ..... H01B 13/02 57/9
2009/0095525 A1 4/2009 Watanabe
(Continued)

FOREIGN PATENT DOCUMENTS

CN 101597707 A 12/2009
CN 102119233 A 7/2011
(Continued)

OTHER PUBLICATIONS

Office Action dated Oct. 20, 2017 by the State Intellectual Property Office of the People's Republic of China in counterpart Application No. 201480028763.5.
(Continued)

*Primary Examiner* — George Wyszomierski
*Assistant Examiner* — Janell C Morillo
(74) *Attorney, Agent, or Firm* — Sughrue Mion, PLLC

(57) ABSTRACT

A method for manufacturing an aluminum wire is provided. The aluminum wire includes an inner-layer conductor having one or a plurality of inner-layer alloy wires including aluminum and an outer-layer conductor having a plurality of outer-layer alloy wires including aluminum and provided on the inner-layer conductor. The method includes an outer-layer twisting step of twisting, over the inner-layer conductor, the outer-layer alloy wires provided on the inner-layer conductor, and an outer-layer rotational compression step of compressing the outer-layer alloy wires twisted in the outer-layer twisting step while being rotated in the same direction as the direction of the twisting in the outer-layer twisting step.

5 Claims, 10 Drawing Sheets

(51) Int. Cl.

| | |
|---|---|
| ***H01B 1/02*** | (2006.01) |
| ***B21C 37/04*** | (2006.01) |
| ***C22C 21/00*** | (2006.01) |
| ***B21C 3/12*** | (2006.01) |
| ***B21C 1/04*** | (2006.01) |
| ***B21C 1/02*** | (2006.01) |
| ***B22D 21/00*** | (2006.01) |
| ***C22C 21/02*** | (2006.01) |
| ***C22C 21/08*** | (2006.01) |
| ***C22F 1/043*** | (2006.01) |
| ***C22F 1/047*** | (2006.01) |
| ***C22F 1/05*** | (2006.01) |
| ***H01B 13/00*** | (2006.01) |
| *C21D 8/06* | (2006.01) |

(52) U.S. Cl.

CPC ..... *B21C 37/045* (2013.01); *B22D 21/007* (2013.01); *C22C 21/00* (2013.01); *C22C 21/02* (2013.01); *C22C 21/08* (2013.01); *C22F 1/04* (2013.01); *C22F 1/043* (2013.01); *C22F 1/047* (2013.01); *C22F 1/05* (2013.01); *H01B 1/023* (2013.01); *H01B 13/0036* (2013.01); *C21D 8/06* (2013.01)

(56) References Cited

U.S. PATENT DOCUMENTS

| | | | | |
|---|---|---|---|---|
| 2010/0059249 | A1* | 3/2010 | Powers | H01B 5/104 174/128.1 |
| 2010/0071933 | A1 | 3/2010 | Otsuka et al. | |
| 2011/0140517 | A1 | 6/2011 | Kusakari et al. | |
| 2013/0126231 | A1 | 5/2013 | Kusakari et al. | |
| 2013/0233596 | A1 | 9/2013 | Ishibashi et al. | |
| 2013/0264115 | A1* | 10/2013 | Kobayashi | H01B 1/023 174/72 A |
| 2013/0284488 | A1 | 10/2013 | Yabuki | |
| 2015/0357072 | A1 | 12/2015 | Kusakari et al. | |

FOREIGN PATENT DOCUMENTS

| | | | | |
|---|---|---|---|---|
| CN | 102360589 | A | 2/2012 | |
| CN | 202495298 | U | 10/2012 | |
| CN | 102800437 | A | 11/2012 | |
| JP | 57-31193 | Y2 | 7/1982 | |
| JP | 7-249329 | A | 9/1995 | |
| JP | 2008-112620 | A | 5/2008 | |
| JP | 2010-67591 | A | 3/2010 | |
| JP | 2012-94258 | A | 5/2012 | |
| JP | 2012-119073 | A | 6/2012 | |
| JP | 5021855 | B1 | 9/2012 | |
| JP | 2013-44040 | A | 3/2013 | |
| WO | WO 2012141041 | A1 * | 10/2012 | H01B 1/023 |

OTHER PUBLICATIONS

Communication dated Aug. 1, 2016, issued by the State Intellectual Property Office of the People's Republic of China in counterpart Chinese Patent Application No. 201480028763.5.

International Search Report dated Aug. 19, 2014 issued in counterpart International Application No. PCT/JP2014/063081 (PCT/ISA/210).

Written Opinion dated Aug. 19, 2014 issued by the International Searching Authority in counterpart Application No. PCT/JP2014/063081.

Communication dated Jan. 11, 2017 issued by the State Intellectual Property Office of P.R. China in counterpart Chinese Patent Application No. 201480028763.5.

Office Action dated Jun. 9, 2017 by the State Intellectual Property Office of P.R. China in counterpart Chinese Patent Application No. 201480028763.5.

Office Action dated May 18, 2018 by the State Intellectual Property Office of P.R. China in counterpart Chinese Patent Application No. 201480028763.5.

Kunming Cable Factory, Shanghai Electric Cable Research Institute, "Chapter III Twisting Apparatus", Feb. 15, 2019, Electric Wire and Cable Technology Series, 6 pages total.

Communication dated Feb. 2, 2019, issued by the State Intellectual Property Office of P.R. China in counterpart Chinese Application No. 201480028763.5.

* cited by examiner (a)

(b)

FIRST ELECTRICAL WIRE

| ROTATION SPEED (rpm) | 1000 | 1500 | 2000 | 2500 | ZERO |
|---|---|---|---|---|---|
| BREAKAGE LOAD | 7.5 | 7.2 | 7.4 | 7.2 | 8.1 |

SECOND ELECTRICAL WIRE

| ROTATION SPEED (rpm) | 1000 | 1500 | 2000 | 2500 | ZERO |
|---|---|---|---|---|---|
| BREAKAGE LOAD | 6.2 | 6.1 | 6.3 | 6.3 | 7.0 |

(a)

(b)

FIRST ELECTRICAL WIRE

| ROTATION SPEED (rpm) | 1000 | 1500 | 2000 | 2500 | ZERO |
|---|---|---|---|---|---|
| CONDUCTOR RESISTANCE | 4.98 | 5.01 | 5.02 | 5.13 | 5.81 |

SECOND ELECTRICAL WIRE

| ROTATION SPEED (rpm) | 1000 | 1500 | 2000 | 2500 | ZERO |
|---|---|---|---|---|---|
| CONDUCTOR RESISTANCE | 4.92 | 5.03 | 4.94 | 4.98 | 5.74 |

(a)

(b)

FIRST ELECTRICAL WIRE

| ROTATION SPEED (rpm) | 1000 | 1500 | 2000 | 2500 | ZERO |
|---|---|---|---|---|---|
| ELONGATION | 17.2 | 18.5 | 17.6 | 18.2 | 15.3 |

SECOND ELECTRICAL WIRE

| ROTATION SPEED (rpm) | 1000 | 1500 | 2000 | 2500 | ZERO |
|---|---|---|---|---|---|
| ELONGATION | 20.8 | 19.7 | 20.6 | 20.5 | 18.1 |

(a)

(b)

FIRST ELECTRICAL WIRE

| ROTATION SPEED (rpm) | 1000 | 1500 | 2000 | 2500 | ZERO |
|---|---|---|---|---|---|
| WIRE BREAKAGE DURABILITY (m/one time) | 157000 | 150000 | 160000 | 159000 | 7000 |

SECOND ELECTRICAL WIRE

| ROTATION SPEED (rpm) | 1000 | 1500 | 2000 | 2500 | ZERO |
|---|---|---|---|---|---|
| WIRE BREAKAGE DURABILITY (m/one time) | 160000 | 158000 | 152000 | 157000 | 10000 |

(a)

(b)

FIRST ELECTRICAL WIRE

| TWIST PITCH (mm) | 10 | 12 | 13 | 15 | 20 | 25 | 30 | 40 |
|---|---|---|---|---|---|---|---|---|
| BREAKAGE LOAD (N) | 8.1 | 7.8 | 7.3 | 7.4 | 7.2 | 7.5 | 7.4 | 7.3 |

SECOND ELECTRICAL WIRE

| TWIST PITCH (mm) | 10 | 12 | 13 | 15 | 20 | 25 | 30 | 40 |
|---|---|---|---|---|---|---|---|---|
| BREAKAGE LOAD (N) | 7.3 | 7.1 | 6.6 | 6.4 | 6.5 | 6.3 | 6.2 | 6.3 |

(a)

(b)

FIRST ELECTRICAL WIRE

| TWIST PITCH (mm) | 10 | 12 | 13 | 15 | 20 | 25 | 30 | 40 |
|---|---|---|---|---|---|---|---|---|
| CONDUCTOR RESISTANCE (mΩ/m) | 5.84 | 5.28 | 5.08 | 5.03 | 5.02 | 5.00 | 5.03 | 4.98 |

SECOND ELECTRICAL WIRE

| TWIST PITCH (mm) | 10 | 12 | 13 | 15 | 20 | 25 | 30 | 40 |
|---|---|---|---|---|---|---|---|---|
| CONDUCTOR RESISTANCE (mΩ/m) | 5.06 | 4.99 | 4.94 | 4.95 | 4.92 | 4.91 | 4.93 | 4.92 |

(a)

(b)

FIRST ELECTRICAL WIRE

| TWIST PITCH (mm) | 10 | 12 | 13 | 15 | 20 | 25 | 30 | 40 |
|---|---|---|---|---|---|---|---|---|
| ELONGATION (%) | 11.3 | 12.6 | 15.5 | 19.2 | 18.1 | 18.6 | 18.2 | 18.3 |

SECOND ELECTRICAL WIRE

| TWIST PITCH (mm) | 10 | 12 | 13 | 15 | 20 | 25 | 30 | 40 |
|---|---|---|---|---|---|---|---|---|
| ELONGATION (%) | 12.4 | 12.8 | 17.9 | 20.0 | 19.8 | 20.4 | 19.9 | 21.0 |

(a)

(b)

FIRST ELECTRICAL WIRE

| TWIST PITCH (mm) | 10 | 12 | 13 | 15 | 20 | 25 | 30 | 40 |
|---|---|---|---|---|---|---|---|---|
| NUMBER OF FLEXINGS | 2050 | 1870 | 1810 | 1780 | 1800 | 1770 | 1790 | 1580 |

SECOND ELECTRICAL WIRE

| TWIST PITCH (mm) | 10 | 12 | 13 | 15 | 20 | 25 | 30 | 40 |
|---|---|---|---|---|---|---|---|---|
| NUMBER OF FLEXINGS | 1990 | 1900 | 1830 | 1800 | 1720 | 1680 | 1660 | 1540 |

ALUMINUM WIRE MANUFACTURING METHOD

CROSS REFERENCE TO RELATED APPLICATIONS

This application is a continuation of International Patent Application No. PCT/JP2014/063081 filed on May 16, 2014, claiming priority from Japanese Patent Application No. 2013-105451 filed on May 17, 2013, the contents of which are incorporated herein by reference.

FIELD OF INVENTION

The present invention relates to a method for manufacturing an aluminum wire.

BACKGROUND ART

Conventionally, wire harnesses having a bundle of wires have been used in wiring structures for transportation machines or apparatus, such as motor vehicles and airplanes, and industrial machines or apparatus, such as robots. Mainstream materials of the wire conductors in the wire harnesses are copper-based materials having excellent electrical conductivity, such as copper and copper alloys.

There recently is a desire for improvements in fuel efficiency of motor vehicles, airplanes, etc., and studies are being made on the use of aluminum, which has a specific gravity that is about ⅓ the specific gravity of copper, as a conductor (see, e.g., JP5021855B1).

However, the aluminum wire described above had a problem in that the conductor is easy to break during the production, resulting in a decrease in the operating efficiency of wire production. Namely, aluminum is easy to work since aluminum has rupture strength of 50% or lower than that of copper and a hardness of 60% or lower than that of copper, but aluminum readily breaks when even slightly excess force is applied thereto.

SUMMARY OF INVENTION

Illustrative aspects of the present invention provides a an aluminum wire manufacturing method for capable of improving operating efficiency of wire production.

According to an illustrative aspect of the present invention, a method for manufacturing an aluminum wire is provided. The aluminum wire includes an inner-layer conductor having at least one inner-layer alloy wire including aluminum and an outer-layer conductor having a plurality of outer-layer alloy wires including aluminum and provided on the inner-layer conductor. The method includes a twisting step of twisting, over the inner-layer conductor, the outer-layer alloy wires provided on the inner-layer conductor; and a rotational compression step of compressing the outer-layer alloy wires twisted in the twisting step while rotating the outer-layer alloy wires in a same direction as a direction of the twisting in the twisting step.

According to the aluminum wire manufacturing method described above, since the outer-layer alloy wires that have been twisted in the twisting step are compressed while being rotated in the same direction as the twisting direction in the twisting step, the force caused by the compression is released in the rotating direction, so that the frictional force is reduced and render the outer-layer conductor less apt to decrease in elongation. As a result, the possibility of wire breakage during the production is lowered, and an improvement in the operating efficiency of wire production can be attained.

The twist pitch in the twisting step may be 13 mm to 30 mm.

With the twist pitch in the twisting step being 13 mm or longer, it is possible to prevent deterioration of the elongation resulting from work hardening which would occur when the tension applied to the outer-layer alloy wires becomes too high and exceeds the proof stress, as in the case where the twist pitch is shorter than 13 mm. Further, setting the twist pitch in the twisting step to be 30 mm or shorter can prevent the flexing property from being deteriorated.

The aluminum wire manufacturing method may further comprise, prior to the twisting step: a casting step of casting an alloy containing 0.5 mass % to 1.3 mass % of iron and 0 mass % to 0.4 mass % of magnesium, with the remainder including aluminum and impurities; an annealing step of annealing the alloy cast in the casting step at a temperature of 250° C. to 450° C.; and a wire drawing step of drawing the alloy obtained in the annealing step to provide the inner-layer alloy wire and the outer-layer alloy wires.

According to the aluminum wire manufacturing method described above, since an alloy containing 0.5 mass % to 1.3 mass % of iron and 0 mass % to 0.4 mass % of magnesium, with the remainder comprising aluminum and impurities, is provided by the casting and annealed at the temperature of 250° C. to 450° C., the magnesium dissolved in the alloy precipitates, whereby the conductor resistance is improved.

The aluminum wire manufacturing method may further comprise, prior to the twisting step: a casting step of casting an alloy containing 0.2 mass % to 1.2 mass % of magnesium and 0.1 mass % to 2.0 mass % of silicon, with the remainder including aluminum and impurities; a first annealing step of appealing the alloy cast in the casting step at a temperature of 400° C. to 630° C.; a wire drawing step of drawing the alloy obtained in the first annealing step to provide the inner-layer alloy wire and the outer-layer alloy wires; and a second annealing step of annealing the inner-layer alloy wire and the outer-layer alloy wires obtained in the wire drawing step at a temperature of 100° C. to 300° C.

According to the aluminum wire manufacturing method described above, since an alloy containing 0.2 mass % to 1.2 mass % of magnesium and 0.1 mass % to 2.0 mass % of silicon, with the remainder comprising aluminum and impurities, is cast and annealed at a temperature of 400° C. to 630° C., the magnesium and the silicon are made to form a solid solution. Furthermore, by annealing the resultant alloy at a temperature of 100° C. to 300° C., a fine precipitate can be formed to attain an improvement in conductor strength.

According to the illustrative aspects of the invention, it is possible to provide an aluminum wire manufacturing method that can improve operating efficiency of wire production.

EMBODIMENTS OF INVENTION

Figure 1:
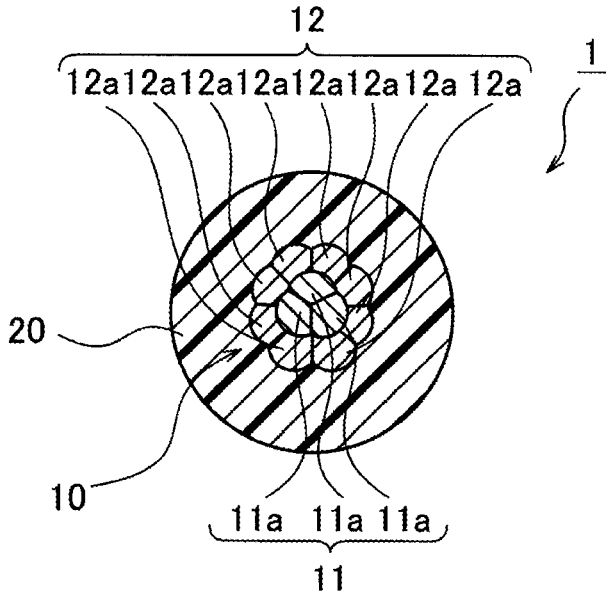
FIG. 1 is a schematic diagram illustrating an example of an aluminum wire produced by an aluminum wire manufacturing method for an according to an embodiment of the invention.

Preferred embodiments of the invention are explained below on the basis of the drawings, but the invention should not be construed as being limited to the following embodiments. FIG. 1 is a schematic diagram illustrating one example of aluminum wires produced by a method for manufacturing an aluminum wire according to an embodiment of the invention.

The aluminum wire 1 according to this embodiment is one obtained by covering a conductor 10 with an insulating member 20 having insulating properties, as shown in FIG. 1. The conductor 10 is configured of an inner-layer conductor 11 and an outer-layer conductor 12 provided on the inner-layer conductor 11, and the area of the cross-section thereof specifically is 0.13 $mm^2$ to 1.5 $mm^2$.

The inner-layer conductor 11 and the outer-layer conductor 12 are configured as stranded wires obtained by twisting a plurality of conductive wires 11*a*, 12*a*. In this embodiment, the wires 11*a*, 12*a* are made of an alloy (inner-layer alloy and outer-layer alloy) including aluminum. Specifically, the alloy contains 0.5 mass % to 1.3 mass % of iron and 0 mass % to 0.4 mass % of magnesium, with the remainder including aluminum and impurities.

The wires 11*a*, 12*a* are not limited to this, and may be made of an alloy containing 0.2 mass % to 1.2 mass % of magnesium and 0.1 mass % to 2.0 mass % of silicon, with the remainder including aluminum and impurities. Further, the wires 11*a*, 12*a* are not limited to those described above, and may contain certain mass % of one or more elements selected from iron, magnesium, silicon, titanium, copper, zinc, nickel, manganese, silver, chromium, and zirconium.

In addition, while the inner-layer conductor 11 consists of three wires 11*a* and the outer-layer conductor 12 consists of eight wires 12*a* in the conductor 10 shown in FIG. 1, this is a non-limiting. For example, the inner-layer conductor 11 may consist of a single wire 11*a* and the outer-layer conductor 12 may consist of six wires 12*a*, or the inner-layer conductor 11 may consist of six wires 11*a* and the outer-layer conductor 12 may consist of ten wires 12*a*. The number of wires 11*a*, 12*a* is not particularly limited.

Figure 2:
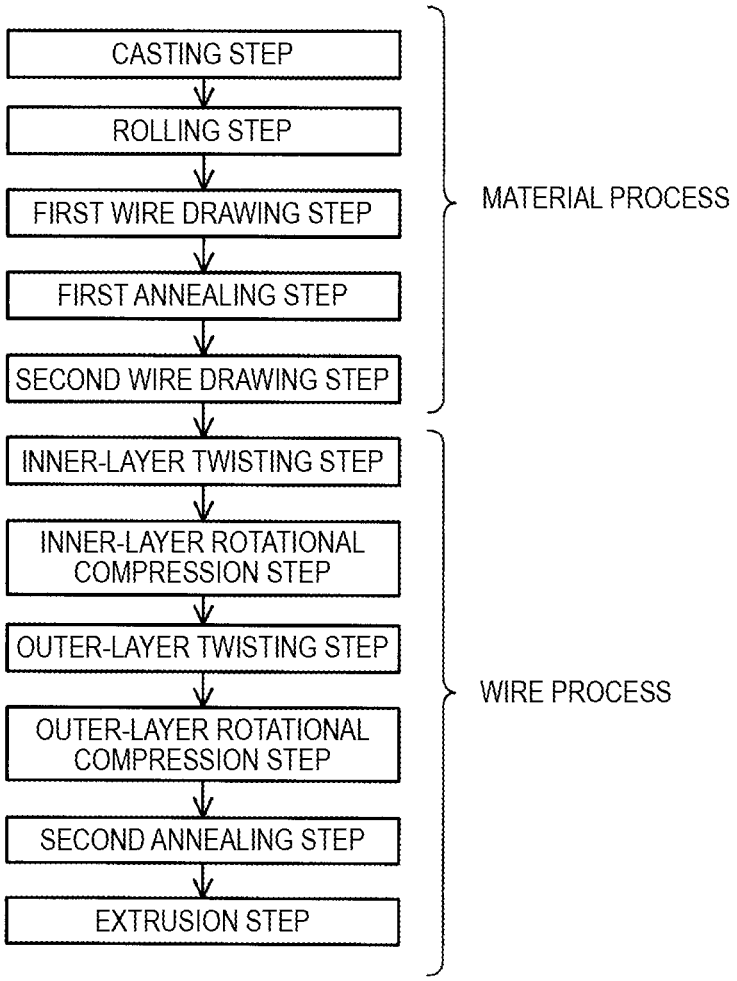
FIG. 2 is a flow chart illustrating an aluminum wire manufacturing method according to this embodiment.

Next, a method for manufacturing an aluminum wire 1 according to this embodiment is roughly explained. FIG. 2 is a flow chart illustrating a method for manufacturing an aluminum wire 1 according to this embodiment. The aluminum wire manufacturing method is divided into a material process for producing wires 11*a*, 12*a* and a wire process for producing an aluminum wire 1 from the wires 11*a*, 12*a*.

The material process includes a casting step, a rolling step, a first wire drawing step, a first annealing step (annealing step), and a second wire drawing step (wire drawing step). In the casting step, an aluminum alloy to be used as the wires 11*a*, 12*a* is produced. In this step is obtained an alloy (hereinafter referred to as alloy 1) which contains 0.5 mass % to 1.3 mass % of iron and 0 mass % to 0.4 mass % of magnesium, with the remainder including aluminum and impurities. Alternatively, an aluminum alloy (hereinafter referred to as alloy 2) which contains 0.2 mass % to 1.2 mass % of magnesium and 0.1 mass % to 2.0 mass % of silicon, with the remainder including aluminum and impurities, may be produced in this step, or still another aluminum alloy may be produced.

Subsequently, the aluminum alloy is subjected to rolling (rolling step), and is drawn into a wire in the first wire drawing step.

Thereafter, a first annealing step is performed, in which the alloy is annealed at a given temperature. In this step, by annealing alloy 1 at 250° C. to 450° C., the magnesium dissolved in the alloy is precipitated to improve the conductor resistance. Meanwhile, by annealing alloy 2 at 400° C. to 630° C., the magnesium and the silicon are made to form a solid solution, and by annealing the resultant alloy at a temperature of 100° C. to 300° C., a fine precipitate can be formed to attain an improvement in conductor strength.

Furthermore, in the case where alloy 1 contains silicon, the magnesium can be precipitated in an increased amount and the conductor resistance can be further improved. In the case where the aluminum alloy contains titanium, the size enlargement of crystal grains during the annealing can be inhibited and the conductor strength can hence be inhibited from decreasing.

The annealing method may be a batch treatment using an atmospheric furnace, a continuous heat treatment based on current application, or a continuous heat treatment based on low-frequency induction heating. When performing the former continuous heat treatment or the continuous heat treatment based on low-frequency induction heating, the same amount of energy as in the batch treatment may be applied.

Subsequently, in the second wire drawing step, the annealed alloy is further drawn to produce the wires 11*a*, 12*a*. Although the wires 11*a* and wires 12*a* described above are made of the same alloy, the wires 11*a*, 12*a* are not limited to these and may be made of different alloys. For example, the wires 11*a* may be alloy 1 and the wires 12*a* may be alloy 2.

The wire process includes an inner-layer twisting step, an inner-layer rotational compression step, an outer-layer twisting step (twisting step), an outer-layer rotational compression step (rotational compression step), a second annealing step, and an extrusion step.

Figure 3:
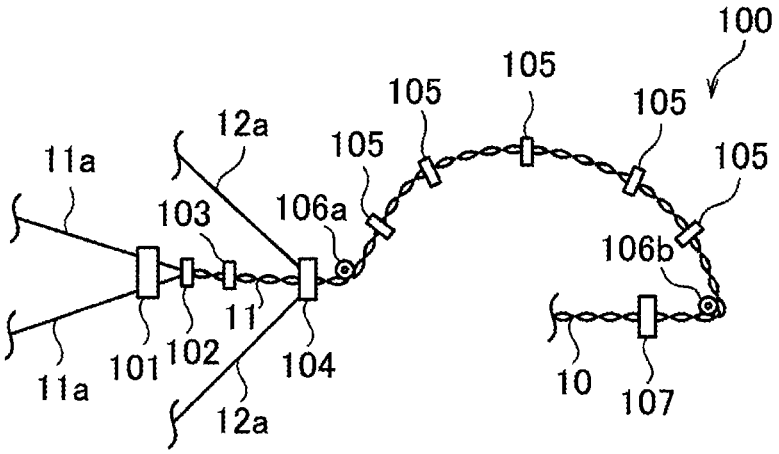
FIG. 3 is a schematic diagram illustrating a manufacturing apparatus for conducting the wire process shown in FIG. 2.

FIG. 3 is a schematic diagram illustrating a manufacturing apparatus for conducting the wire process shown in FIG. 2. As shown in FIG. 3, the manufacturing apparatus 100 is equipped with an inner-layer twisting port 101, an inner-layer rotary guide 102, an inner-layer rotary die 103, an outer-layer twisting port 104, a plurality of outer-layer rotary guides 105, rollers 106*a* and 106*b*, and an outer-layer rotary die 107.

An inner-layer twisting step is performed in which a plurality of inner-layer-alloy wires 11*a* is collected through the inner-layer twisting port 101 and twisted by the inner-layer rotary guide 102 which is rotating. Subsequently, the multiple inner-layer-alloy wires 11*a* that have been twisted are supplied to the inner-layer rotary die 103, and an inner-layer rotational compression step is performed.

Figure 4:
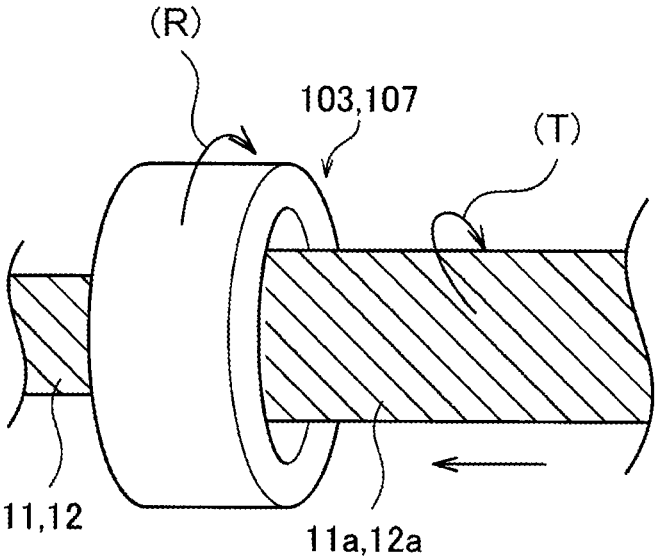
FIG. 4 is an enlarged view of the inner-layer rotary die and outer-layer rotary die shown in FIG. 3.

FIG. 4 is an enlarged view of the inner-layer rotary die 103 and outer-layer rotary die 107 shown in FIG. 3. As shown in FIG. 4, the multiple inner-layer-alloy wires 11*a* that have been twisted are compressed by the inner-layer rotary die 103 to form an inner-layer conductor 11. The inner-layer rotary die 103 is rotating on the longitudinal-direction axis of the twisted inner-layer-alloy wires 11*a*. Because of this, some of the compressive force of the inner-layer rotary die 103 escapes in the direction of revolution (R), and the multiple inner-layer-alloy wires 11*a* that have been twisted have reduced force of friction with the die.

Furthermore, in the inner-layer rotational compression step, since the inner-layer rotary die 103 is rotated in the same direction as the twisting direction (T) in the inner-layer twisting step, the inner-layer-alloy wires 11*a* are not rotated in the direction in which the inner-layer-alloy wires 11*a* would be untwisted. Therefore, it is possible prevent an occurrence of untwisting.

Reference is made again to FIG. 3. The inner-layer conductor 11 formed by the inner-layer rotary die 103 is supplied to the outer-layer twisting port 104. Meanwhile, a plurality of outer-layer alloy wires 12*a* is supplied to the outer-layer twisting port 104, and the multiple outer-layer alloy wires 12*a* are provided on the inner-layer conductor 11. An outer-layer twisting step is then performed in which the multiple outer-layer alloy wires 12*a* provided on the inner-layer conductor 11 are led via the roller 106*a* to the multiple outer-layer rotary guides 105 and are twisted on the inner-layer conductor 11 by the multiple outer-layer rotary guides 105.

In this outer-layer twisting step, the twist pitch is 13 mm to 30 mm. Setting the twist pitch to be 13 mm or longer can prevent deterioration of the elongation resulting from work hardening which would occur in a case where the tension applied to the outer-layer alloy wires 12*a* becomes too high and exceeds the proof stress, as in the case where the twist pitch is shorter than 13 mm. Further, setting the twist pitch to be 30 mm or shorter can prevent the flexing property from being deteriorated.

The outer-layer rotary guides 105 are arranged in a form of an arch. Therefore, when one turn is given to the arch, the twisting can be performed twice.

The multiple outer-layer alloy wires 12*a* twisted on the inner-layer conductor 11 by such multiple outer-layer rotary guides 105 are supplied via the roller 106*b* to the outer-layer rotary die 107 to conduct an outer-layer rotational compression step.

As shown in FIG. 4, the multiple outer-layer alloy wires 12*a* twisted on the inner-layer conductor 11 are compressed by the outer-layer rotary die 107 to form an outer-layer conductor 12 (conductor 10). The outer-layer rotary die 107 is rotating on the longitudinal-direction axis of the twisted outer-layer alloy wires 12*a*. Because of this, some of the compressive force of the outer-layer rotary die 107 escapes in the direction of revolution (R), and the multiple outer-layer alloy wires 12*a* that have been twisted have reduced force of friction with the die.

Furthermore, in the outer-layer rotational compression step, since the outer-layer rotary die 107 is rotated in the same direction as the twisting direction (T) in the outer-layer twisting step, the outer-layer alloy wires 12*a* are not rotated in the direction in which the outer-layer alloy wires 12*a* would be untwisted. Therefore, it is possible to prevent an occurrence of untwisting.

Reference is made again to FIG. 2. By conducting the outer-layer rotational compression step, the conductor 10 is produced. After the production of the conductor 10, a second annealing step is performed, in which the conductor 10 is annealed at a given temperature. Like the first annealing step, the second annealing step may be performed by a batch treatment using an atmospheric furnace, a continuous heat treatment based on voltage application, or a continuous heat treatment based on low-frequency induction heating. When performing the former continuous heat treatment or the continuous heat treatment based on low-frequency induction heating, the same amount of energy as in the batch treatment may be applied.

In the second annealing step, the strains due to work hardening which were caused by the conductor processing (the first wire drawing step, second wire drawing step, inner-layer twisting step, inner-layer rotational compression step, outer-layer twisting step, and outer-layer rotational compression step) are removed. Furthermore, in the case where the aluminum alloy is alloy 1, the magnesium which remained unprecipitated in the first annealing step is precipitated, and a further improvement in conductor resistance can hence be attained.

The annealing temperature in the second annealing step may be 250° C. to 450° C. in the case where the aluminum alloy is alloy 1, or may be 100° C. to 300° C. in the case where the aluminum alloy is alloy 2.

The conductor 10 produced through the steps described above is covered with an insulating member 20 in an extrusion step. Thus, an aluminum wire 1 according to this embodiment is produced.

Figure 5:
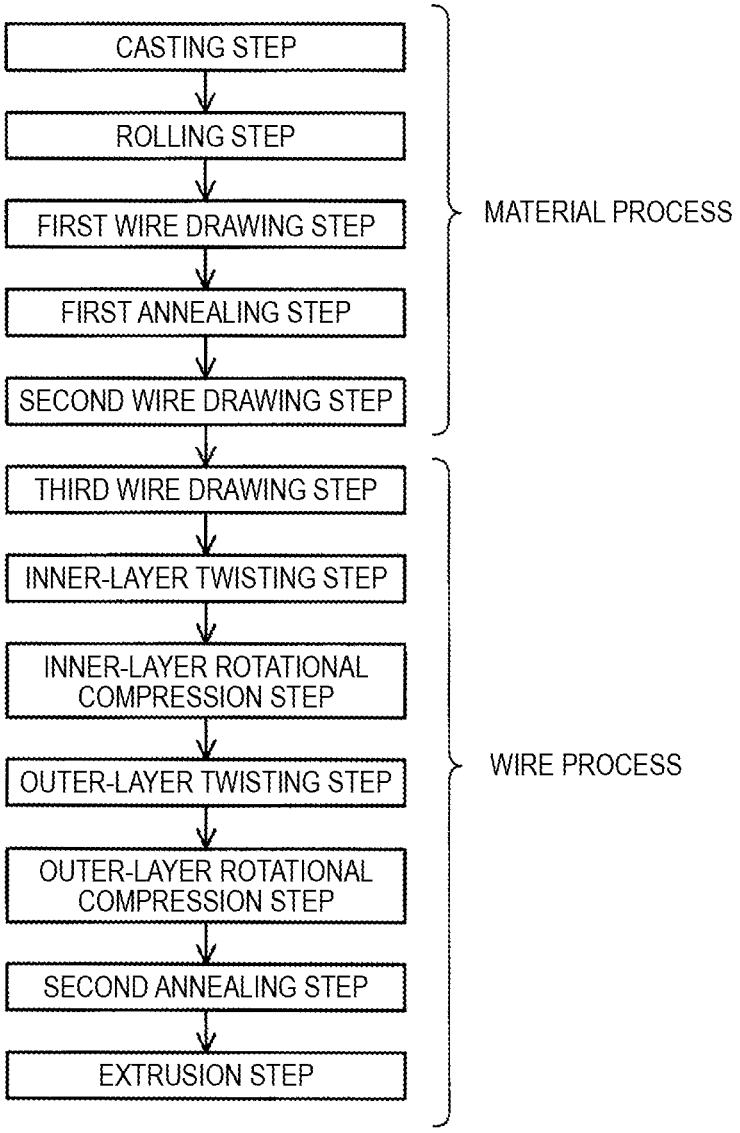
FIG. 5 is a flow chart illustrating another example (first example) of an aluminum wire manufacturing method according to this embodiment.

FIG. 5 to FIG. 8 are flow charts which show other examples of the method for manufacturing an aluminum wire 1 according to this embodiment. As shown in FIG. 5, for the aluminum wire 1, a third wire drawing step (some of the wire process) may be added between the second wire drawing step and the inner-layer twisting step. As such, the alloy is gradually drawn in the first to third wire drawing steps to produce the wires 11*a*, 12*a*. Thus, the alloy is not drawn at a time, whereby the likelihood of metal break during the drawing of the alloy can be lowered and the wires 11*a*, 12*a* can be made to have a smaller diameter.

Figure 6:
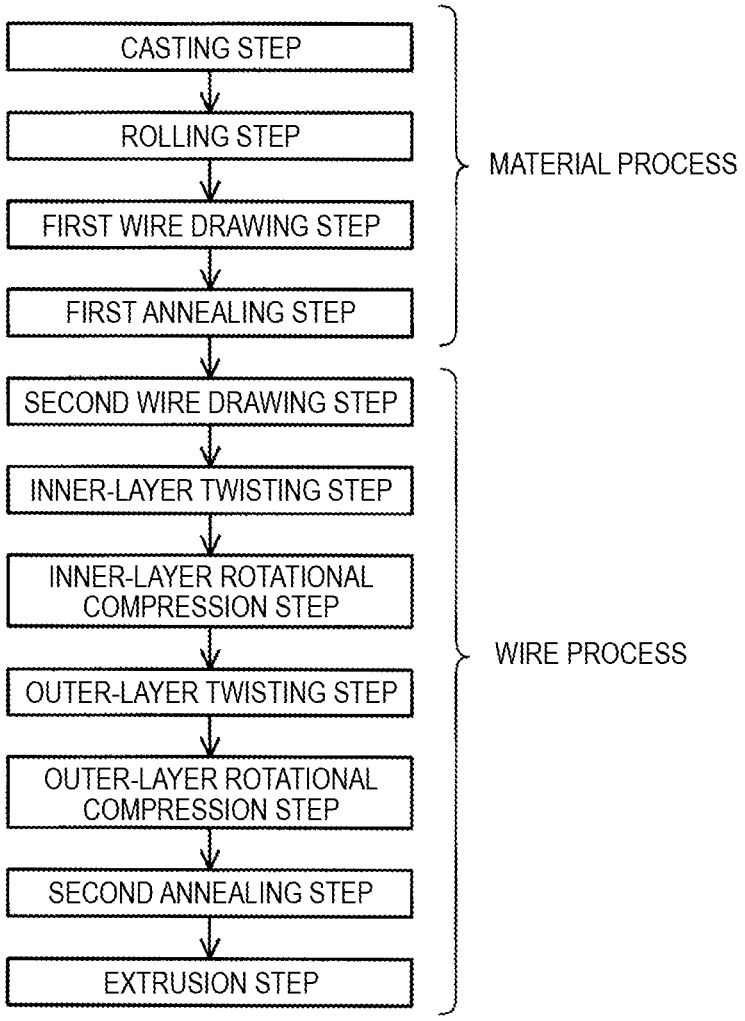
FIG. 6 is a flow chart illustrating another example (second example) of an aluminum wire manufacturing method according to this embodiment.
Figure 7:
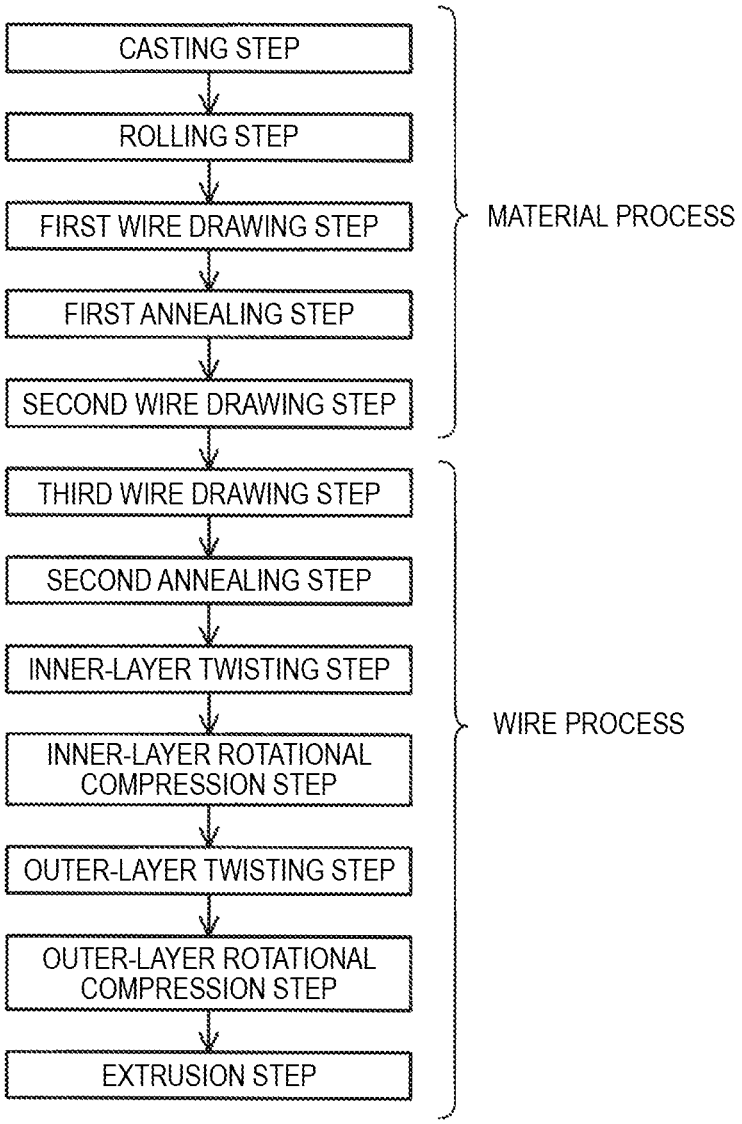
FIG. 7 is a flow chart illustrating another example (third example) of an aluminum wire manufacturing method according to this embodiment.

As shown in FIG. 6, the second wire drawing step may be included in the wire process. As shown in FIG. 7, the second annealing step may be performed before the inner-layer twisting step. In this case, the annealing is performed after the work hardening of the wires 11*a*, 12*a* which will occur in the later steps is predicted.

Figure 8:
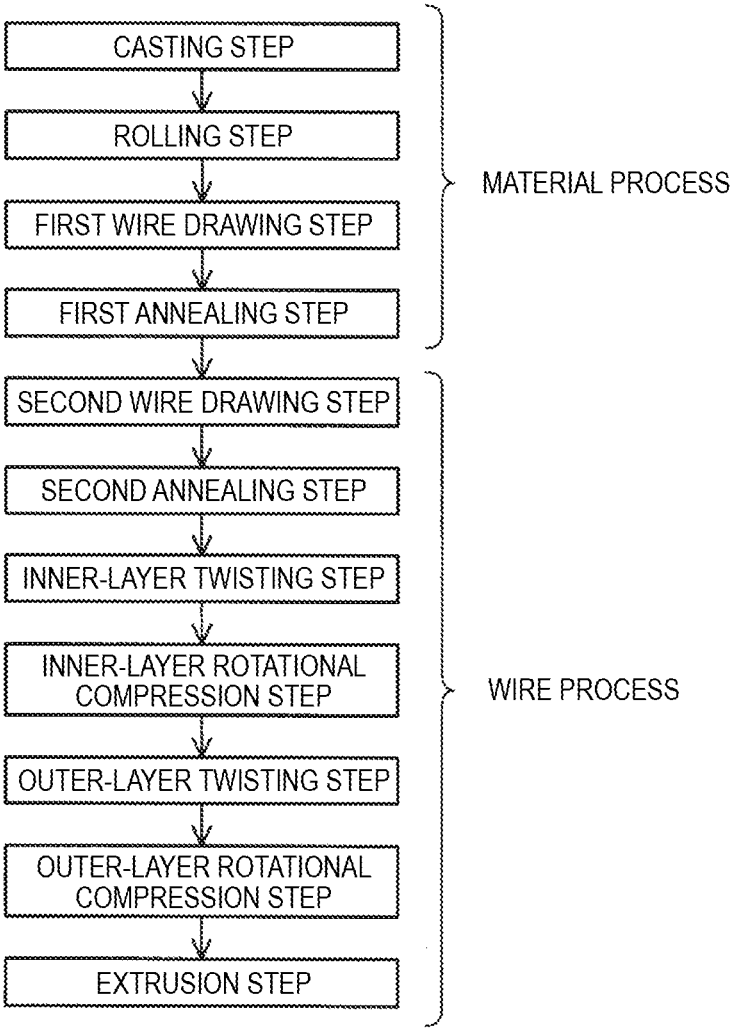
FIG. 8 is a flow chart illustrating another example (fourth example) of an aluminum wire manufacturing method according to this embodiment.

Furthermore, production steps shown in FIG. 6 and production steps shown in FIG. 7 may be performed in combination as shown in FIG. 8.

As described above, the method for manufacturing an aluminum wire 1 according to this embodiment can be variously modified. It is a matter of course that manufacturing methods other than the manufacturing methods shown in FIG. 2 and FIG. 5 to FIG. 8 can be employed.

Figure 9:
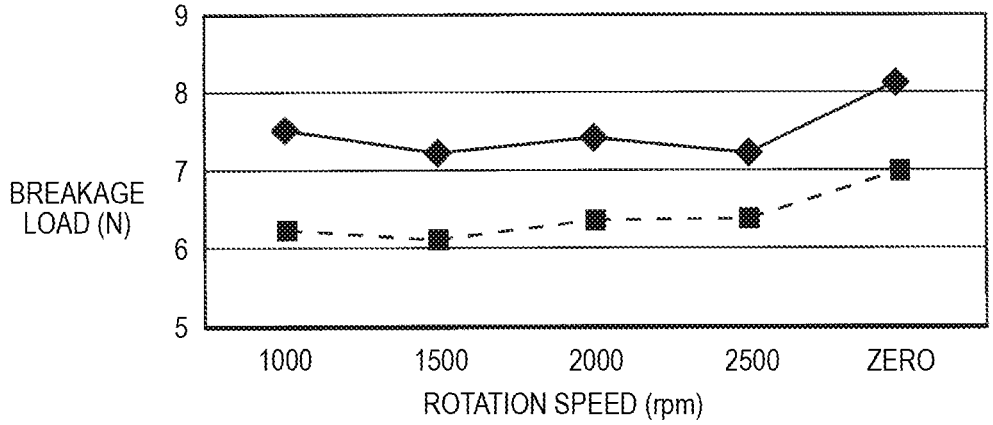
FIG. 9 shows a correlation between the rotation speed of an outer-layer rotary die in an outer-layer rotational compression step and the breakage load of the outer-layer conductor, in which FIG. 9(*a*) shows a graph, and FIG. 9(*b*) shows tables.
Figure 10:
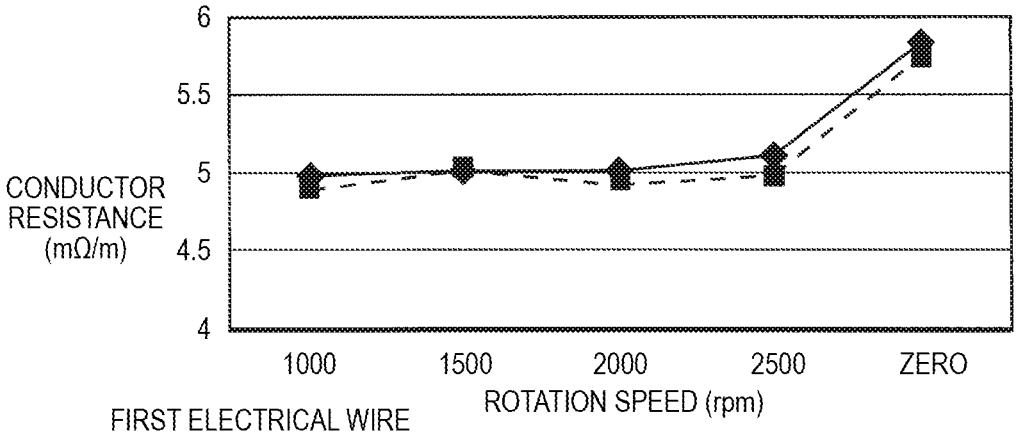
FIG. 10 shows a correlation between the rotation speed of an outer-layer rotary die in an outer-layer rotational compression step and the conductor resistance of the outer-layer conductor, in which FIG. 10(*a*) shows a graph, and FIG. 10(*b*) shows tables.
Figure 11:
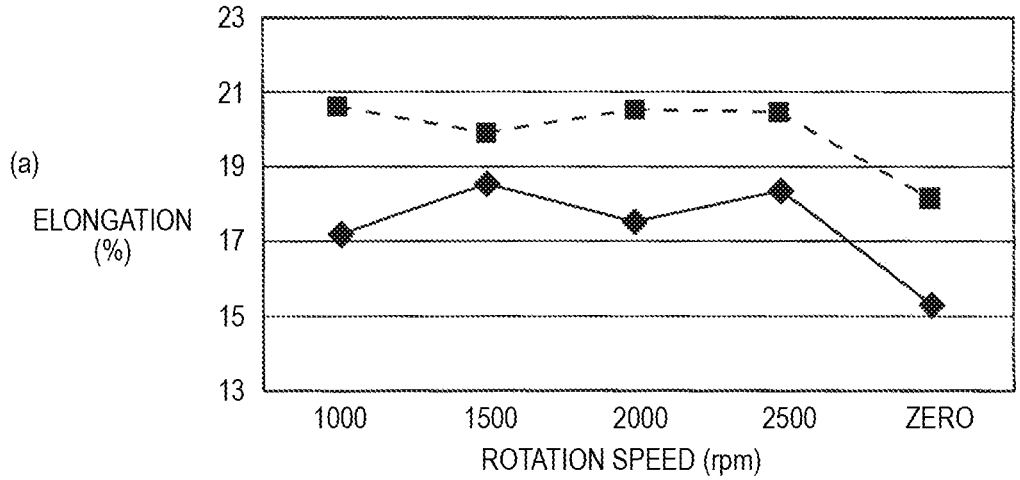
FIG. 11 shows a correlation between the rotation speed of an outer-layer rotary die in an outer-layer rotational compression step and the elongation of the outer-layer conductor, in which FIG. 11(*a*) shows a graph, and FIG. 11(*b*) shows tables.

The aluminum wires 1 thus produced have the properties shown in FIG. 9 to FIG. 11. The aluminum wires 1 shown below include: a first electrical wire in which the aluminum alloy is one kind of alloy 1 that contains 0.6 mass % of iron, 0.3 mass % of magnesium, and 0.002 mass % of zirconium, with the remainder including aluminum and impurities; and a second electrical wire in which the aluminum alloy is another kind of alloy 1 that contains 1.2 mass % of iron and 0.002 mass % of zirconium, with the remainder including aluminum and impurities.

In a first annealing step, annealing was performed at 410° C. for 3 hours. The inner-layer-alloy and outer-layer alloy wires 11*a*, 12*a* had a cross-sectional area of 0.7266 $mm^2$, and the number of the inner-layer-alloy wires 11*a* was 3 and that of the outer-layer alloy wires 12*a* was 8.

FIG. 9 shows a correlation between the rotation speed of the outer-layer rotary die 107 in an outer-layer rotational compression step and the breakage load of the outer-layer conductor 12, in which FIG. 9(*a*) shows a graph, and FIG. 9(*b*) shows tables.

As shown in FIG. 9(*a*) and FIG. 9(*b*), in the first electrical wire, when the rotation speed of the outer-layer rotary die 107 is 1,000 rpm, the breakage load of the outer-layer conductor 12 is 7.5 N. When the rotation speed of the outer-layer rotary die 107 is 1,500 rpm, the breakage load of the outer-layer conductor 12 is 7.2 N. When the rotation speed of the outer-layer rotary die 107 is 2,000 rpm, the breakage load of the outer-layer conductor 12 is 7.4 N. Furthermore, when the rotation speed of the outer-layer rotary die 107 is 2,500 rpm, the breakage load of the outer-layer conductor 12 is 7.2 N.

In contrast, in the case where the outer-layer rotary die 107 is not rotated, the breakage load of the outer-layer conductor 12 in the first electrical wire is 8.1 N.

In the second electrical wire, when the rotation speed of the outer-layer rotary die 107 is 1,000 rpm, the breakage load of the outer-layer conductor 12 is 6.2 N. When the rotation speed of the outer-layer rotary die 107 is 1,500 rpm, the breakage load of the outer-layer conductor 12 is 6.1 N. When the rotation speed of the outer-layer rotary die 107 is 2,000 rpm, the breakage load of the outer-layer conductor 12 is 6.3 N. Furthermore, when the rotation speed of the outer-layer rotary die 107 is 2,500 rpm, the breakage load of the outer-layer conductor 12 is 6.3 N.

In contrast, in the case where the outer-layer rotary die 107 is not rotated, the breakage load of the outer-layer conductor 12 in the second electrical wire is 7.0 N.

FIG. 10 shows a correlation between the rotation speed of the outer-layer rotary die 107 in an outer-layer rotational compression step and the conductor resistance of the outer-layer conductor 12, in which FIG. 10(*a*) shows a graph, and FIG. 10(*b*) shows tables.

As shown in FIG. 10(*a*) and FIG. 10(*b*), in the first electrical wire, when the rotation speed of the outer-layer rotary die 107 is 1,000 rpm, the conductor resistance of the outer-layer conductor 12 is 4.98 mΩ/m. When the rotation speed of the outer-layer rotary die 107 is 1,500 rpm, the conductor resistance of the outer-layer conductor 12 is 5.01 When the rotation speed of the outer-layer rotary die 107 is 2,000 rpm, the conductor resistance of the outer-layer conductor 12 is 5.02 mΩ/m. Furthermore, when the rotation speed of the outer-layer rotary die 107 is 2,500 rpm, the conductor resistance of the outer-layer conductor 12 is 5.13 mΩ/m.

In contrast, in the case where the outer-layer rotary die 107 is not rotated, the conductor resistance of the outer-layer conductor 12 in the first electrical wire is 5.81 mΩ/m.

In the second electrical wire, when the rotation speed of the outer-layer rotary die 107 is 1,000 rpm, the conductor resistance of the outer-layer conductor 12 is 4.92 mΩ/m. When the rotation speed of the outer-layer rotary die 107 is 1,500 rpm, the conductor resistance of the outer-layer conductor 12 is 5.03 mΩ/m. When the rotation speed of the outer-layer rotary die 107 is 2,000 rpm, the conductor resistance of the outer-layer conductor 12 is 4.94 mΩ/m. Furthermore, when the rotation speed of the outer-layer rotary die 107 is 2,500 rpm, the conductor resistance of the outer-layer conductor 12 is 4.98 mΩ/m.

In contrast, in the case where the outer-layer rotary die 107 is not rotated, the conductor resistance of the outer-layer conductor 12 in the second electrical wire is 5.64 mΩ/m.

FIG. 11 shows a correlation between the rotation speed of the outer-layer rotary die 107 in an outer-layer rotational compression step and the elongation of the outer-layer conductor 12, in which FIG. 11(*a*) shows a graph, and FIG. 11(*b*) shows tables.

As shown in FIG. 11(*a*) and FIG. 11(*b*), in the first electrical wire, when the rotation speed of the outer-layer rotary die 107 is 1,000 rpm, the elongation of the outer-layer conductor 12 is 17.2%. When the rotation speed of the outer-layer rotary die 107 is 1,500 rpm, the elongation of the outer-layer conductor 12 is 18.5%. When the rotation speed of the outer-layer rotary die 107 is 2,000 rpm, the elongation of the outer-layer conductor 12 is 17.6%. Furthermore, when the rotation speed of the outer-layer rotary die 107 is 2,500 rpm, the elongation of the outer-layer conductor 12 is 18.2%.

In contrast, in the case where the outer-layer rotary die 107 is not rotated, the elongation of the outer-layer conductor 12 in the first electrical wire is 15.3%.

In the second electrical wire, when the rotation speed of the outer-layer rotary die 107 is 1,000 rpm, the elongation of the outer-layer conductor 12 is 20.8%. When the rotation speed of the outer-layer rotary die 107 is 1,500 rpm, the elongation of the outer-layer conductor 12 is 19.7%. When the rotation speed of the outer-layer rotary die 107 is 2,000 rpm, the elongation of the outer-layer conductor 12 is 20.6%. Furthermore, when the rotation speed of the outer-layer rotary die 107 is 2,500 rpm, the elongation of the outer-layer conductor 12 is 20.5%.

In contrast, in the case where the outer-layer rotary die 107 is not rotated, the elongation of the outer-layer conductor 12 in the second electrical wire is 18.1%.

It is known that in conductors, there is a correlation between the conductor resistance and the elongation. Namely, it is known that an increase in conductor resistance tends to result in a decrease in elongation. It is further known that there also is a correlation between the breakage load and the elongation. Namely, it is known that a decrease in breakage load tends to result in an increase in elongation.

As described above, it has been found that in the method for manufacturing an aluminum wire 1 according to this embodiment, by compressing the outer-layer alloy wires 12*a* with the outer-layer rotary die 107 while revolving the wires 12*a* therewith, the friction with the die is reduced and the outer-layer conductor 12 is made to have an increased elongation although reduced in breakage load.

Figure 12:
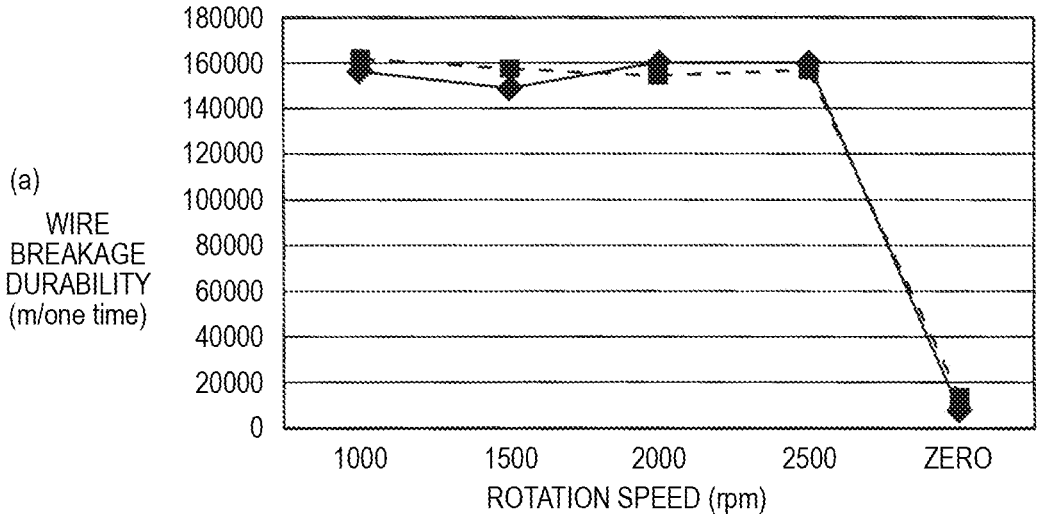
FIG. 12 shows a correlation between the rotation speed of an outer-layer rotary die in an outer-layer rotational compression step and the wire breakage durability of the outer-layer alloy wires, in which FIG. 12(*a*) shows a graph, and FIG. 12(*b*) shows tables.

Since the elongation of the outer-layer conductor 12 is increased, the properties shown in FIG. 12 are obtained. FIG. 12 shows a correlation between the rotation speed of the outer-layer rotary die 107 in an outer-layer rotational compression step and the wire breakage durability of the outer-layer alloy wires 12*a*, in which FIG. 12(*a*) shows a graph, and FIG. 12(*b*) shows tables. The wire breakage durability is a value which indicates the length (meters) of the outer-layer conductor 12 produced before the occurrence of one wire breakage.

As shown in FIG. 12(*a*) and FIG. 12(*b*), in the first electrical wire, when the rotation speed of the outer-layer rotary die 107 is 1,000 rpm, the wire breakage durability of the outer-layer conductor 12 is 157,000 meters. When the rotation speed of the outer-layer rotary die 107 is 1,500 rpm, the wire breakage durability of the outer-layer conductor 12 is 150,000 meters. When the rotation speed of the outer-layer rotary die 107 is 2,000 rpm, the wire breakage durability of the outer-layer conductor 12 is 160,000 meters. Furthermore, when the rotation speed of the outer-layer rotary die 107 is 2,500 rpm, the wire breakage durability of the outer-layer conductor 12 is 159,000 meters.

In contrast, in the case where the outer-layer rotary die 107 is not rotated, the wire breakage durability of the outer-layer conductor 12 in the first electrical wire is 7,000 meters.

In the second electrical wire, when the rotation speed of the outer-layer rotary die 107 is 1,000 rpm, the wire breakage durability of the outer-layer conductor 12 is 160,000 meters. When the rotation speed of the outer-layer rotary die 107 is 1,500 rpm, the wire breakage durability of the outer-layer conductor 12 is 158,000 meters. When the rotation speed of the outer-layer rotary die 107 is 2,000 rpm, the wire breakage durability of the outer-layer conductor 12 is 152,000 meters. Furthermore, when the rotation speed of the outer-layer rotary die 107 is 2,500 rpm, the wire breakage durability of the outer-layer conductor 12 is 157,000 meters.

In contrast, in the case where the outer-layer rotary die 107 is not rotated, the wire breakage durability of the outer-layer conductor 12 in the second electrical wire is 10,000 meters.

As described above, it has been found that the method for manufacturing an aluminum wire 1 according to this embodiment enhances the elongation of the outer-layer conductor 12 to thereby improve the wire breakage durability and improve the operating efficiency of wire production. The reason for these effects is thought to be that some of the compressive force of the outer-layer rotary die 107 escapes in the direction of revolution (R) and that the multiple outer-layer alloy wires 12*a* that have been twisted are evenly compressed and have come to have reduced force of friction with the die.

It is desirable that the twist pitch in the outer-layer twisting step be 13 mm to 30 mm. An explanation is given below with reference to FIG. 13 to FIG. 16. The data shown in FIG. 13 to FIG. 16 are data on the conductors 10 forming the first electrical wire and second electrical wire, the conductors 10 being produced under the conditions of a rotation speed of the outer-layer rotary die 107 of 2,000 rpm.

Figure 13:
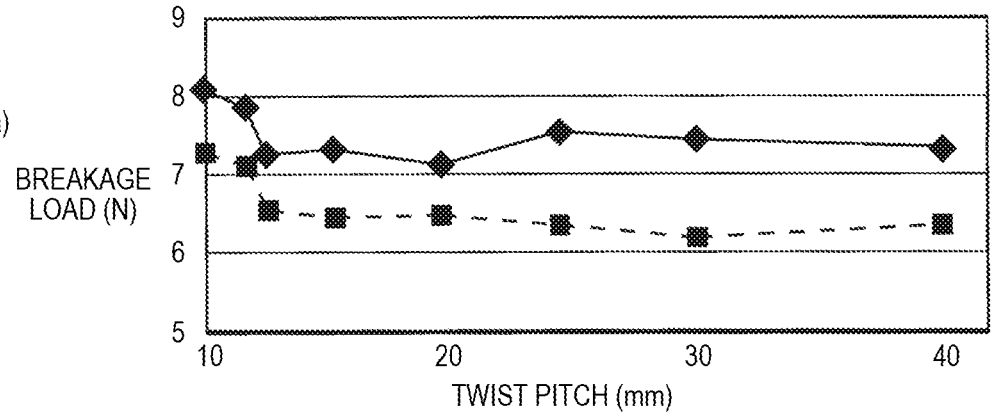
FIG. 13 shows a correlation between the twist pitch in an outer-layer twisting step and the breakage load of the outer-layer conductor, in which FIG. 13(*a*) shows a graph, and FIG. 13(*b*) shows tables.

FIG. 13 shows a correlation between the twist pitch in an outer-layer twisting step and the breakage load of the outer-layer conductor 12, in which FIG. 13(*a*) shows a graph, and FIG. 13(*b*) shows tables.

As shown in FIG. 13(*a*) and FIG. 13(*b*), in the first electrical wire, when the twist pitch is 10 mm, the breakage load of the outer-layer conductor 12 is 8.1 N. When the twist pitch is 12 mm, the breakage load of the outer-layer conductor 12 is 7.8 N. When the twist pitch is 13 mm, the breakage load of the outer-layer conductor 12 is 7.3 N. When the twist pitch is 15 mm, the breakage load of the outer-layer conductor 12 is 7.4 N. When the twist pitch is 20 mm, the breakage load of the outer-layer conductor 12 is 7.2 N. When the twist pitch is 25 mm, the breakage load of the outer-layer conductor 12 is 7.5 N. When the twist pitch is 30 mm, the breakage load of the outer-layer conductor 12 is 7.4 N. Furthermore, when the twist pitch is 40 mm, the breakage load of the outer-layer conductor 12 is 7.3 N.

In the second electrical wire, when the twist pitch is 10 mm, the breakage load of the outer-layer conductor 12 is 7.3 N. When the twist pitch is 12 mm, the breakage load of the outer-layer conductor 12 is 7.1 N. When the twist pitch is 13 mm, the breakage load of the outer-layer conductor 12 is 6.6 N. When the twist pitch is 15 mm, the breakage load of the outer-layer conductor 12 is 6.4 N. When the twist pitch is 20 mm, the breakage load of the outer-layer conductor 12 is 6.5 N. When the twist pitch is 25 mm, the breakage load of the outer-layer conductor 12 is 6.3 N. When the twist pitch is 30 mm, the breakage load of the outer-layer conductor 12 is 6.2 N. Furthermore, when the twist pitch is 40 mm, the breakage load of the outer-layer conductor 12 is 6.3 N.

Figure 14:
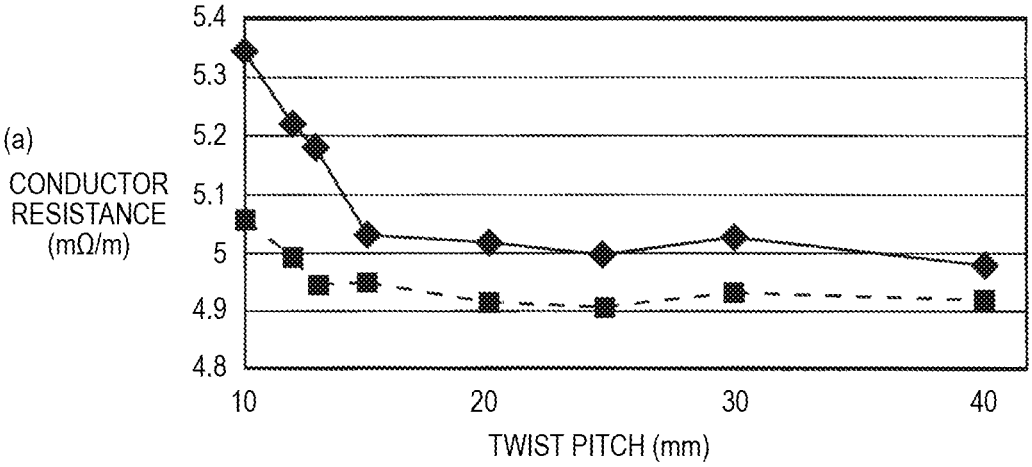
FIG. 14 shows a correlation between the twist pitch in an outer-layer twisting step and the conductor resistance of the outer-layer conductor, in which FIG. 14(*a*) shows a graph, and FIG. 14(*b*) shows tables.

FIG. 14 shows a correlation between the twist pitch in an outer-layer twisting step and the conductor resistance of the outer-layer conductor 12, in which FIG. 14(*a*) shows a graph, and FIG. 14(*b*) shows tables.

As shown in FIG. 14(*a*) and FIG. 14(*b*), in the first electrical wire, when the twist pitch is 10 mm, the conductor resistance of the outer-layer conductor 12 is 5.34 mΩ/m. When the twist pitch is 12 mm, the conductor resistance of the outer-layer conductor 12 is 5.22 mΩ/m. When the twist pitch is 13 mm, the conductor resistance of the outer-layer conductor 12 is 5.08 mΩ/m. When the twist pitch is 15 mm, the conductor resistance of the outer-layer conductor 12 is 5.03 mΩ/m. When the twist pitch is 20 mm, the conductor resistance of the outer-layer conductor 12 is 5.02 mΩ/m. When the twist pitch is 25 mm, the conductor resistance of the outer-layer conductor 12 is 5.00 mΩ/m. When the twist pitch is 30 mm, the conductor resistance of the outer-layer conductor 12 is 5.03 mΩ/m. Furthermore, when the twist pitch is 40 mm, the conductor resistance of the outer-layer conductor 12 is 4.98 mΩ/m.

In the second electrical wire, when the twist pitch is 10 mm, the conductor resistance of the outer-layer conductor 12 is 5.06 mΩ/m. When the twist pitch is 12 mm, the conductor resistance of the outer-layer conductor 12 is 4.99 mΩ/m. When the twist pitch is 13 mm, the conductor resistance of the outer-layer conductor 12 is 4.94 mΩ/m. When the twist pitch is 15 mm, the conductor resistance of the outer-layer conductor 12 is 4.95 mΩ/m. When the twist pitch is 20 mm, the conductor resistance of the outer-layer conductor 12 is 4.92 mΩ/m. When the twist pitch is 25 mm, the conductor resistance of the outer-layer conductor 12 is 4.91 mΩ/m. When the twist pitch is 30 mm, the conductor resistance of the outer-layer conductor 12 is 4.93 mΩ/m. Furthermore, when the twist pitch is 40 mm, the conductor resistance of the outer-layer conductor 12 is 4.92 mΩ/m.

Figure 15:
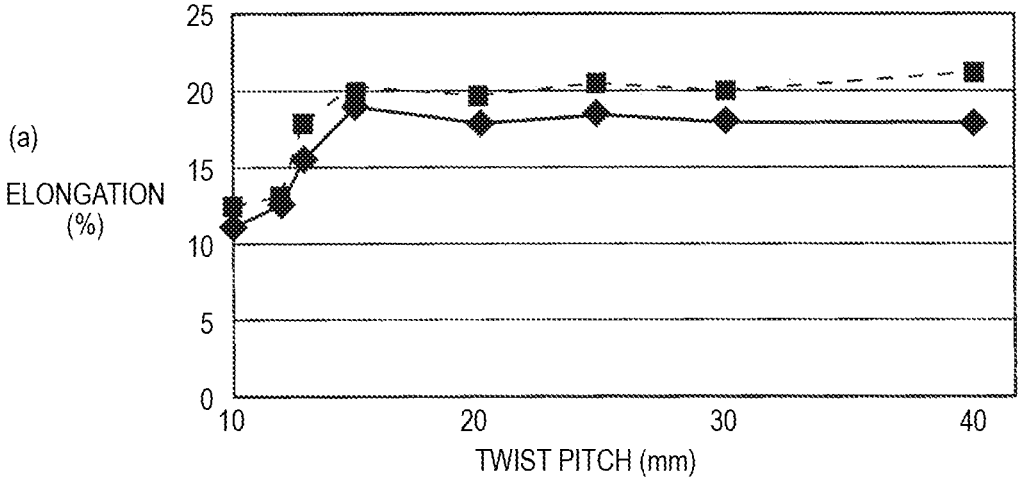
FIG. 15 shows a correlation between the twist pitch in an outer-layer twisting step and the elongation of the outer-layer conductor, in which FIG. 15(*a*) shows a graph, and FIG. 15(*b*) shows tables.

FIG. 15 shows a correlation between the twist pitch in an outer-layer twisting step and the elongation of the outer-layer conductor 12, in which FIG. 15(*a*) shows a graph, and FIG. 15(*b*) shows tables.

As shown in FIG. 15(*a*) and FIG. 15(*b*), in the first electrical wire, when the twist pitch is 10 mm, the elongation of the outer-layer conductor 12 is 11.3%. When the twist pitch is 12 mm, the elongation of the outer-layer conductor 12 is 12.6%. When the twist pitch is 13 mm, the elongation of the outer-layer conductor 12 is 15.5%. When the twist pitch is 15 mm, the elongation of the outer-layer conductor 12 is 19.2%. When the twist pitch is 20 mm, the elongation of the outer-layer conductor 12 is 18.1%. When the twist pitch is 25 mm, the elongation of the outer-layer conductor 12 is 18.6%. When the twist pitch is 30 mm, the elongation of the outer-layer conductor 12 is 18.2%. Furthermore, when the twist pitch is 40 mm, the elongation of the outer-layer conductor 12 is 18.3%.

In the second electrical wire, when the twist pitch is 10 mm, the elongation of the outer-layer conductor 12 is 12.4%. When the twist pitch is 12 mm, the elongation of the outer-layer conductor 12 is 12.8%. When the twist pitch is 13 mm, the elongation of the outer-layer conductor 12 is 17.9%. When the twist pitch is 15 mm, the elongation of the outer-layer conductor 12 is 20.0%. When the twist pitch is 20 mm, the elongation of the outer-layer conductor 12 is 19.8%. When the twist pitch is 25 mm, the elongation of the outer-layer conductor 12 is 20.4%. When the twist pitch is 30 mm, the elongation of the outer-layer conductor 12 is 19.9%. Furthermore, when the twist pitch is 40 mm, the elongation of the outer-layer conductor 12 is 21.0%.

As described above, it was found that although the breakage load of the outer-layer conductor 12 tends to become lower as the twist pitch increases, the products obtained with twist pitches as long as 13 mm or more retain a breakage load of about 6 N or higher and are not problematic. With respect to conductor resistance, it was found that although a conductor resistance of 5.10 mΩ/m or less can be maintained so long as the twist pitch is 13 mm or longer, twist pitches less than 13 mm render the outer-layer conductor 12 unable to retain a conductor resistance of 5.10 mΩ/m. Furthermore, with respect to elongation, it was found that although an elongation of 15% or higher can be maintained so long as the twist pitch is 13 mm or longer, twist pitches less than 13 mm render the outer-layer conductor 12 unable to retain an elongation of 15%.

Consequently, it was found that the twist pitch in the outer-layer twisting step is preferably 13 mm or longer.

Figure 16:
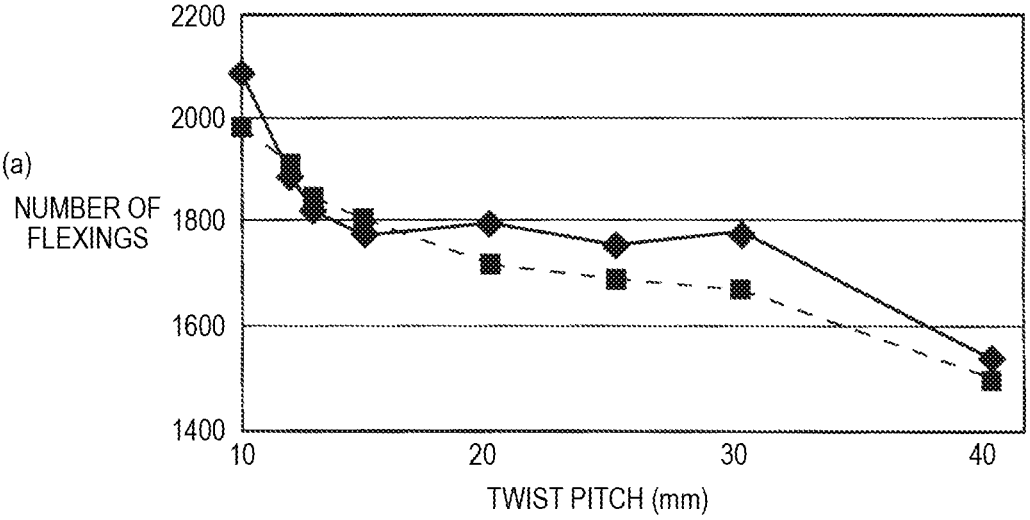
FIG. 16 shows a correlation between the twist pitch in an outer-layer twisting step and the flexing properties of the outer-layer conductor, in which FIG. 16(*a*) shows a graph, and FIG. 16(*b*) shows tables.

FIG. 16 shows a correlation between the twist pitch in an outer-layer twisting step and the flexing properties of the outer-layer conductor 12, in which FIG. 16(*a*) shows a graph, and FIG. 16(*b*) shows tables. FIG. 16 shows the results of a 180° flexing test which was performed using a mandrel having a diameter of 25 mm under the conditions of a load being 400 g and a flexing rate being twice/sec. In case where the outer-layer conductor 12 has a value of resistance increased by 10%, this electrical wire is unable to be used in appliances in which conductor resistance control is necessary. Consequently, the number of flexings to an increase in resistance value of 10% was determined in FIG. 16.

As shown in FIG. 16(*a*) and FIG. 16(*b*), in the first electrical wire, when the twist pitch was 10 mm, the number of flexings to a 10% increase in the resistance value of the outer-layer conductor 12 was 2,050. When the twist pitch was 12 mm, the number of flexings to a 10% increase in the resistance value of the outer-layer conductor 12 was 1,980. When the twist pitch was 13 mm, the number of flexings to a 10% increase in the resistance value of the outer-layer conductor 12 was 1,900. When the twist pitch was 15 mm, the number of flexings to a 10% increase in the resistance value of the outer-layer conductor 12 was 1,820. When the twist pitch was 20 mm, the number of flexings to a 10% increase in the resistance value of the outer-layer conductor 12 was 1,800. When the twist pitch was 25 mm, the number of flexings to a 10% increase in the resistance value of the outer-layer conductor 12 was 1,750. When the twist pitch was 30 mm, the number of flexings to a 10% increase in the resistance value of the outer-layer conductor 12 was 1,700. Furthermore, when the twist pitch was 40 mm, the number of flexings to a 10% increase in the resistance value of the outer-layer conductor 12 was 1,580.

In the second electrical wire, when the twist pitch was 10 mm, the number of flexings to a 10% increase in the resistance value of the outer-layer conductor 12 was 1,990. When the twist pitch was 12 mm, the number of flexings to a 10% increase in the resistance value of the outer-layer conductor 12 was 1,900. When the twist pitch was 13 mm, the number of flexings to a 10% increase in the resistance value of the outer-layer conductor 12 was 1,830. When the twist pitch was 15 mm, the number of flexings to a 10% increase in the resistance value of the outer-layer conductor 12 was 1,800. When the twist pitch was 20 mm, the number of flexings to a 10% increase in the resistance value of the outer-layer conductor 12 was 1,720. When the twist pitch was 25 mm, the number of flexings to a 10% increase in the resistance value of the outer-layer conductor 12 was 1,680. When the twist pitch was 30 mm, the number of flexings to a 10% increase in the resistance value of the outer-layer conductor 12 was 1,660. Furthermore, when the twist pitch was 40 mm, the number of flexings to a 10% increase in the resistance value of the outer-layer conductor 12 was 1,540.

As described above, it was found that although the number of flexings to a 10% increase in the resistance value of the outer-layer conductor 12 can be about 1,600 or larger when the twist pitch is 30 mm or shorter, the number of flexings to a 10% increase in the resistance value of the outer-layer conductor 12 cannot be about 1,600 when the twist pitch exceeds 30 mm.

It was hence found that the twist pitch in the outer-layer twisting step is preferably 30 mm or shorter. Consequently, it was found that the twist pitch in the outer-layer twisting step is preferably 13 mm to 30 mm.

In accordance with the method for manufacturing an aluminum wire 1 according to this embodiment, since the outer-layer alloy wires 12*a* twisted in the twisting step are compressed while being rotated in the same direction as the direction of twisting (T) used in the twisting step, the force caused by the compression escapes in the direction of revolution (R) to thereby reduce the frictional force and render the work hardening less apt to occur. The outer-layer conductor 12 hence is less apt to decrease in elongation. As a result, the possibility of wire breakage during the production is lowered, and an improvement in the operating efficiency of wire production can be attained.

Furthermore, since the die is rotated in the same direction as the direction of twisting (T) in the twisting step, the outer-layer conductor 12 in the rotational compression step is not rotated in the direction in which the outer-layer conductor 12 would be untwisted. Therefore, it is possible to prevent an occurrence of untwisting.

In addition, the twist pitch in the twisting step is 13 mm or longer. Therefore, it is possible to prevent deterioration of the elongation resulting from work hardening which would occur in a case where the tension applied to the outer-layer alloy wires 12*a* becomes too high and exceeds the proof stress, as in the case where the twist pitch shorter than 13 mm. Moreover, since the twist pitch in the twisting step is 30 mm or shorter, it is possible to prevent the flexing property from being deteriorated.

Furthermore, since an alloy containing 0.5 mass % to 1.3 mass % of iron and 0 mass % to 0.4 mass % of magnesium, with the remainder including aluminum and impurities, is cast and annealed at a temperature of 250° C. to 450° C., the magnesium dissolved in the alloy precipitates, thereby improving the conductor resistance.

Moreover, by casting an alloy containing 0.2 mass % to 1.2 mass % of magnesium and 0.1 mass % to 2.0 mass % of silicon, with the remainder including aluminum and impurities, annealing the cast alloy at a temperature of 400° C. to 630° C. to thereby make the magnesium and the silicon form a solid solution, and annealing the resultant alloy at 100° C. to 300° C., a fine precipitate can be formed to attain an improvement in conductor strength.

While the present invention has been described with reference to embodiments thereof, the present invention is not limited to the embodiments described above, and modifications can be made therein without departing from the idea of the invention. For example, while the inner-layer conductor 11 of the embodiments is supposed to have a size of 0.13 $mm^2$, the conductor size is not limited thereto and may be larger than 0.13 $mm^2$.

In the embodiment described above, the second annealing step may be performed after the outer-layer twisting step and before the outer-layer rotational compression step. In this case, the annealing is performed after the work hardening which will occur in the outer-layer rotational compression step is predicted. The second annealing step may also be performed after the inner-layer twisting step and before the inner-layer rotational compression step. In this case, the annealing is performed after the work hardening which will occur in the inner-layer rotational compression step and outer-layer rotational compression step is predicted.

Furthermore, the aluminum alloys of the inner-layer conductor 11 and outer-layer conductor 12 are not limited to alloy 1 and alloy 2, and the number of inner-layer-alloy wires 11*a* and that of wires 12*a* of the outer-layer conductor 12 are not limited to those described above. In a case where there is a single inner-layer-alloy wire 11*a*, the inner-layer twisting step and the inner-layer rotational compression step shown in FIG. 2 and FIG. 5 to FIG. 8 may be omitted.

Here, the features of the embodiments of the aluminum wire manufacturing method according to the invention described above are briefly summarized below as [1] to [4].

[1] A method for manufacturing an aluminum wire (1) including an inner-layer conductor (11) having one or a plurality of inner-layer alloy wires (11*a*) including aluminum and an outer-layer conductor (12) having a plurality of outer-layer alloy wires (12*a*) including aluminum and provided on the inner-layer conductor (11), the method including:

a twisting step of twisting, over the inner-layer conductor (11), the outer-layer alloy wires (12*a*) provided on the inner-layer conductor (11); and a rotational compression step of compressing the outer-layer alloy wires (12*a*) twisted in the twisting step while rotating the outer-layer alloy wires in the same direction as the direction of the twisting in the twisting step.

[2] The method for manufacturing an aluminum wire (1) having the configuration [1] described above, wherein the twist pitch in the twisting step is 13 mm to 30 mm.

[3] The method for manufacturing an aluminum wire (1) according to [1] or [2], including, prior to the twisting step:

a casting step of casting an alloy containing 0.5 mass % to 1.3 mass % of iron and 0 mass % to 0.4 mass % of magnesium, with the remainder including aluminum and impurities;

an annealing step of annealing the alloy cast in the casting step at a temperature of 250° C. to 450° C.; and a wire drawing step of drawing the alloy obtained in the annealing step to provide the inner-layer alloy wire (11*a*) and the outer-layer alloy wires (12*a*).

[4] The method for manufacturing the aluminum wire (1), including, prior to the twisting step:

a casting step of casting an alloy containing 0.2 mass % to 1.2 mass % of magnesium and 0.1 mass % to 2.0 mass % of silicon, with the remainder comprising aluminum and impurities;

a first annealing step of annealing the alloy cast in the casting step at a temperature of 400° C. to 630° C.;

a wire drawing step of drawing the alloy obtained in the first annealing step to provide the inner-layer alloy wire (11*a*) and the outer-layer alloy wires (12*a*); and a second annealing step of annealing the inner-layer alloy wire (11*a*) and the outer-layer alloy wires (12*a*) obtained in the wire drawing step at a temperature of 100° C. to 300° C.

What is claimed is:

1. A method for manufacturing an aluminum wire comprising an inner-layer conductor having at least one inner-layer alloy wire including aluminum and an outer-layer conductor having a plurality of outer-layer alloy wires including aluminum and provided on the inner-layer conductor, the method comprising:

an inner-layer twisting step of twisting, in a twisting direction, a plurality of inner-layer alloy wires, including the at least one inner-layer alloy wire, to form the inner-layer conductor;

an inner-layer rotational compression step of compressing the plurality of inner-layer alloy wires twisted in the inner-layer twisting step;

an outer-layer twisting step of twisting, in the twisting direction and over the inner-layer conductor, the outer-layer alloy wires provided on the inner-layer conductor that is performed after the inner-layer rotational compression step; and an outer-layer rotational compression step of compressing the outer-layer alloy wires twisted in the outer-layer twisting step while rotating the outer-layer alloy wires in a same direction as the twisting direction of the twisting in the inner-layer twisting step and the outer-layer twisting step.

2. The method according to claim 1, wherein a twist pitch in the outer-layer twisting step is 13 mm to 30 mm.

3. The method according to claim 1, further comprising, prior to the outer-layer twisting step:

a casting step of casting an alloy containing 0.5 mass % to 1.3 mass % of iron and 0 mass % to 0.4 mass % of magnesium, with the remainder including aluminum and impurities;

an annealing step of annealing the alloy cast in the casting step at a temperature of 250° C. to 450° C.; and a wire drawing step of drawing the alloy obtained in the annealing step to provide the inner-layer alloy wire and the outer-layer alloy wires.

4. The method according to claim 1, further comprising, prior to the outer-layer twisting step:

a casting step of casting an alloy containing 0.2 mass % to 1.2 mass % of magnesium, 0.1 mass % to 2.0 mass % of silicon, and the remainder including aluminum and impurities;

a first annealing step of appealing the alloy cast in the casting step at a temperature of 400° C. to 630° C.;

a wire drawing step of drawing the alloy obtained in the first annealing step to provide the inner-layer alloy wire and the outer-layer alloy wires; and a second annealing step of annealing the inner-layer alloy wire and the outer-layer alloy wires obtained in the wire drawing step at a temperature of 100° C. to 300° C.

5. The method according to claim 1, wherein the at least one inner-layer alloy wire is a first alloy, and wherein the plurality of outer-layer alloy wires is a second alloy that is different than the first alloy.

* * * * *